US012264606B1

(12) United States Patent
Banks, III

(10) Patent No.: US 12,264,606 B1
(45) Date of Patent: Apr. 1, 2025

(54) OIL PAN WITH AIR RETURN PORTS FOR DIRECTING AIRFLOW IN INTERNAL COMBUSTION ENGINES

(71) Applicant: Gale C. Banks, III, Bradbury, CA (US)

(72) Inventor: Gale C. Banks, III, Bradbury, CA (US)

( * ) Notice: Subject to any disclaimer, the term of this patent is extended or adjusted under 35 U.S.C. 154(b) by 0 days.

(21) Appl. No.: 18/933,074

(22) Filed: Oct. 31, 2024

(51) Int. Cl.
*F01M 11/00* (2006.01)
*F01M 11/03* (2006.01)

(52) U.S. Cl.
CPC ..... *F01M 11/0004* (2013.01); *F01M 11/03* (2013.01); *F01M 2011/005* (2013.01); *F01M 2011/031* (2013.01)

(58) Field of Classification Search
CPC ..... F01M 11/0004; F01M 11/03; F01M 2011/005; F01M 2011/031; F01M 5/002; F01M 1/02; B01D 45/08
See application file for complete search history.

(56) References Cited

U.S. PATENT DOCUMENTS 3,106,263 A 10/1963 Mckellar
4,270,497 A 6/1981 Valerio
4,519,348 A 5/1985 Hamilton
D317,923 S 7/1991 Barrett
5,103,782 A 4/1992 Matsui
D346,741 S 5/1994 McIntyre
5,809,963 A 9/1998 Saito
6,019,071 A * 2/2000 Maciejka, Jr. ..... F01P 3/08 123/41.35
6,058,898 A 5/2000 Freese, V
6,340,012 B1 1/2002 Yamashita et al.
D544,509 S 6/2007 Tiller et al.
7,341,039 B1 * 3/2008 Jaszewski ..... F01M 11/0004 123/196 R
7,637,337 B2 12/2009 Stranges
D637,636 S 5/2011 Liao
D641,385 S 7/2011 Armstrong
D660,892 S 5/2012 Tomlinson et al.
D683,777 S 6/2013 Forbis et al.
D685,830 S 7/2013 Lai
D821,445 S 6/2018 Buchen et al.
D842,911 S 3/2019 O'Neill et al.
10,385,742 B2 * 8/2019 Dunn ..... F01M 13/0011
D902,100 S 11/2020 Mendoza
10,934,904 B2 3/2021 Banks, III
D933,727 S 10/2021 Liao et al.
D979,622 S 2/2023 Hudnall et al.
2004/0177827 A1 9/2004 Hoyte et al.
(Continued)

*Primary Examiner* — Syed O Hasan
(74) *Attorney, Agent, or Firm* — Batt IP A Law Corporation; Richard Batt

(57) ABSTRACT

A system for collecting lube oil in an internal combustion engine with a rotating cranktrain which reduces lube oil aeration. The system includes a first side wall and a second side wall opposite the first side wall. An oil accumulation ramp extends downwards from the second side wall to the first side wall, and separates the oil sump from the crankcase. An oil entrance aperture is arranged in the ramp near the first side wall for directing oil accumulating on the ramp into the oil sump. A plurality of air return ports extend through the oil accumulation ramp from the oil sump to the crankcase. The shape and aim of the air return ports are tuned to optimize the pressure of air and oil level in the sump.

27 Claims, 17 Drawing Sheets

(56) References Cited

U.S. PATENT DOCUMENTS

| | | | | |
|---|---|---|---|---|
| 2008/0257625 | A1 | 10/2008 | Stranges | |
| 2010/0132655 | A1* | 6/2010 | Wunsch | F01M 13/04 123/196 R |
| 2012/0067319 | A1* | 3/2012 | Cygan, Jr. | F01M 11/0004 123/196 A |

* cited by examiner

| | | DESIGN 1 (PRIOR ART) | DESIGN 2 | CHANGE | % CHANGE |
|---|---|---|---|---|---|
| TOTAL OIL IN SYSTEM (ALL TESTS) | | 12.0 | 12.0 | | |
| 2400 RPM | SUMP LEVEL (qt) | 7.4 | 8.3 | +0.9 | 12.2% |
| | OIL IN ROTATING GROUP (qt) | 4.6 | 3.7 | -0.9 | -19.6% |
| | OIL TEMPERATURE (F) | 226.3 | 223.3 | -3.0 | -1.3% |
| | OIL PRESSURE (PSIG) | 54.5 | 54.5 | 0.0 | 0.0% |
| | | | | | |
| 2800 RPM | SUMP LEVEL (qt) | 5.9 | 7.3 | +1.4 | 23.7% |
| | OIL IN ROTATING GROUP (qt) | 6.1 | 4.7 | -1.4 | -23.0% |
| | OIL TEMPERATURE (F) | 246.3 | 241.3 | -5.0 | -2.0% |
| | OIL PRESSURE (PSIG) | 48.7 | 52.2 | +3.5 | 7.2% |
| | | | | | |
| 3150 RPM | SUMP LEVEL (qt) | 5.0 | 5.8 | +0.8 | 16.0% |
| | OIL IN ROTATING GROUP (qt) | 7.0 | 6.2 | -0.8 | -11.4% |
| | OIL TEMPERATURE (F) | 252.9 | 246.7 | -6.2 | -2.5% |
| | OIL PRESSURE (PSIG) | 50.3 | 54.7 | +4.4 | 8.7% |
| | AERATION (%) | 8.95% | 6.12% | - | -31.6% |

FIG. 14

OIL PAN WITH AIR RETURN PORTS FOR DIRECTING AIRFLOW IN INTERNAL COMBUSTION ENGINES

CROSS-REFERENCE TO RELATED APPLICATIONS

None.

BACKGROUND

Engines have a number of reciprocating and/or rotating components that reside within the crankcase. Examples of the reciprocating and/or rotating components include the crankshaft, connecting rods, and pistons (collectively referred to herein as the "cranktrain"). Many of these components such as pistons require oil for cooling and lubrication. The lube oil is pumped from a sump into a system of passages to the frictional interfaces or to cooling nozzles that spray components in need of cooling. Once lube oil exits the frictional interfaces or component cooling interfaces, its job is done. Maintaining an ample volume of oil in the sump is important to ensure that it is available to be pumped through the engine at all times, including when the engine is operating at adverse angles during uphill, downhill, or sidehill driving. As the level of oil available in the sump falls, the risk of terminal engine damage due to oil starvation rises.

However, and with reference to FIG. 1, various problems arise in the above described systems because the lube oil 10 is entrained in the engine system 12 and is being centrifuged and impacted by the rotating components and propelled into the rotating components by the reciprocating components. An example of this phenomena is the high velocity oil/air cyclonic cloud 20 illustrated in FIG. 1.

The above mentioned problem has been addressed by various technologies to limited degree. For example, and with reference to FIG. 2, crankshaft scraper systems 50 comprising a scraper 60, impact surface, or similar device have been utilized to impact and deflect oil 70 from the rotating and reciprocating components into the oil sump 80. In the process a tremendous amount of work is done to the oil to impact and deflect it into the oil sump, heating and aerating the oil in the process. Further, aerodynamic drag is created by the scraper system or, impact surfaces, loading the rotating group parasitically as high aerodynamic drag is created at the scraper interface, or impact surfaces, increasing parasitic losses and diminishing the engine's power output when using a given quantity of fuel. This is undesirable. Additionally, scraper systems and other impact surfaces aerate engine oil. Increased engine oil aeration reduces the oils lubricating performance, thermal performance, load carrying capability (through reduced film strength), and reduce the useful live of the oil. Reducing engine oil aeration thus improves the performance and durability of the engine as a whole.

U.S. Pat. No. 10,934,904 to Banks III describes another lube oil aeration and thermal control system. With reference to FIG. 3, the system 200 shown in the '904 Patent generally includes a primary plate 210 and a discrete main oil accumulation plate 220. The oil flow path ($O_1$) is gently directed by the primary plate 210 in the same direction as the crankshaft rotation towards the main plate 220. The oil wets the main plate surface and is urged towards the separator entrance aperture 250. Despite overcoming some of the challenges associated with use of a scraper, the design set forth in the '904 Patent can be improved to reduce parasitic force losses and resulting aeration arising from the airflow across the main accumulation plate 220.

Accordingly, a new and improved system that overcomes the above mentioned shortcomings is desired.

SUMMARY OF THE INVENTION

Embodiments of the invention include systems that serve to keep as much oil as possible in the oil sump while minimizing the volume of oil in the cranktrain/crankcase, and to minimize the level of oil aeration.

In embodiments, a system for collecting lube oil in an oil sump in an internal combustion engine with a rotating cranktrain comprises: a first side wall and a second side wall opposite the first side wall; an oil accumulation ramp extending downwards from the second side wall to the first side wall, and separating the oil sump from the cranktrain; and an oil entrance aperture arranged in the ramp near the first side wall for directing oil accumulating on the ramp into the oil sump.

In embodiments, the system further comprises a plurality of air return ports or passages extending through the ramp from the oil sump to the crankcase. In other embodiments, the oil accumulation ramp includes solely one or at least one air return port extending through the ramp from the oil sump to the crankcase.

In embodiments, the air return ports commence at least 1 to 2 in., or more preferably, 1 to 1.5 in. from the second wall.

In embodiments, the air return ports have a passageway length ranging from 0.25 to 1 in.

In embodiments, a ratio ($R_1$) of the cross sectional area of the air return ports (collectively) to the oil entrance aperture ranges from ⅓ to 1/1, and in some embodiments is about ½ to ⅝.

In embodiments, at least one flow delineator or barrier is incorporated into the ramp and arranged between adjacent air return ports to obstruct airflow and divert airflow into the adjacent air return ports. In embodiments, the flow delineators are arranged on the sides of the air return ports regardless of whether the flow delineator is between two adjacent air return ports.

In embodiments, the air return ports are arranged to create vectorized airflow jets.

In embodiments, a plurality of air return ports is arranged to aim the flow along the lateral plane towards the rear, middle or front of the engine. In embodiments, the air return ports aim the flow along the lateral plane towards the oil pump pickup in the oil sump. This serves to push the oil into the oil sump and towards the area of the oil pump pickup.

In embodiments, when the air return ports are inline, some of the air return ports are arranged at an angle (5-45 degrees) from the medial plane while other air return ports are arranged to direct the flow straight (0 degrees).

In embodiments, an air flowpath extends from the oil sump towards the second wall, upwards and through one port, through the crankcase air-oil interface region, through a downstream air-oil entrance aperture adjacent the first wall, and back to the sump. In this embodiment, along such a functional flowpath or streamline, there is only one slot or port for the airflow to travel from the sump to the air-oil interface region. There are no downstream air return ports along a functional flowpath. This configuration is advantageous because there are fewer obstructions to airflow, and drag is reduced along the functional flowpath.

The arrangement and shape of the air return ports (namely, the tuning) as described herein serves to optimally direct air out of the oil sump while maintaining the oil in the sump, as well as maintain higher pressure in the oil sump. Removing air from the oil in the sump will improve the lubricating and cooling capability of the oil, which will improve performance and longevity of the engine and lubricating oil.

In embodiments, the air return ports are tunable through the use of port throttles. For example, in some embodiments, the size of the outlet of each of the air return ports is adjustable. In a particular embodiment, a port throttle is operable to move from an open position in which the port outlet is uncovered, to a second position in which the port outlet is completely occluded, or partially occluded.

In embodiments, the air return ports are tuned based on sensor data or feedback arising from the engine such as, for example, engine speed, oil pressure, and/or oil temperature. In embodiments, the air return ports are adjusted based on the change in engine speed. In embodiments, when a change in engine speed is detected, a port throttle control module is operable to adjust the throttle to the port(s) and in particular embodiments, by rotating the throttle. The port throttle control module may operate the port throttles in proportional response to changes in one or multiple parameters as defined by calibration software.

In embodiments, the oil accumulation ramp comprises a plurality of regions, each having a different curvature.

In embodiments, the oil accumulation ramp comprises a warped upper surface, directing the oil accumulated thereon both downwards and in the direction of the oil pickup, and optionally, the curvature varies with distance from the second wall. In embodiments, the curvature of the warped surface varies with distance from the oil pump pickup.

In embodiments, the oil accumulation ramp and side walls are incorporated into one-piece midpan assembly adapted to be fastened to the crankcase on the top, and to the oil pan on the bottom.

In embodiments, an internal combustion engine having reduced lube oil aeration comprises: an engine block including a rotating cranktrain and a plurality of oil passages; a crankcase; an oil sump for collecting and storing oil arranged below the crankcase; an oil accumulation ramp extending from a first side wall to a second side wall and separating the crankcase from the oil sump; and an entrance aperture in the ramp in the vicinity of the first wall to direct oil accumulated on the ramp into the oil sump.

In embodiments, the engine further comprises a plurality of air return ports extending through the oil accumulation ramp for directing air from the oil sump towards the cranktrain.

In embodiments, the engine further comprises an oil filter arranged along a flowpath of the oil, downstream of the oil pump, and prior to the oil distribution galleries.

In embodiments, the engine further comprises an oil cooler arranged along the flowpath of the oil, downstream of the oil pump, and prior to the oil distribution galleries.

An objective and advantage of embodiments of the invention is to keep as much oil as possible in the oil sump while minimizing the volume of oil in the cranktrain/crankcase.

An objective and advantage of embodiments of the invention is to minimize the level of oil aeration, reduce oil temperature, and increase oil pressure.

An objective and advantage of the invention is to increase air pressure in the sump to reduce the risk of oil pump inlet cavitation, and to reduce the work required by the oil pump to circulate oil through the engine.

BRIEF DESCRIPTION OF FIGURES

The above-mentioned aspects, as well as other features, aspects and advantages of the present technology will now be described in connection with various embodiments, with reference to the accompanying drawings. The illustrated embodiments, however, are merely examples and are not intended to be limiting. Throughout the drawings, similar symbols typically identify similar components, unless context dictates otherwise where:

FIG. 14 is an illustration of test data in tabular format.

DESCRIPTION OF THE INVENTION

Figure 1:
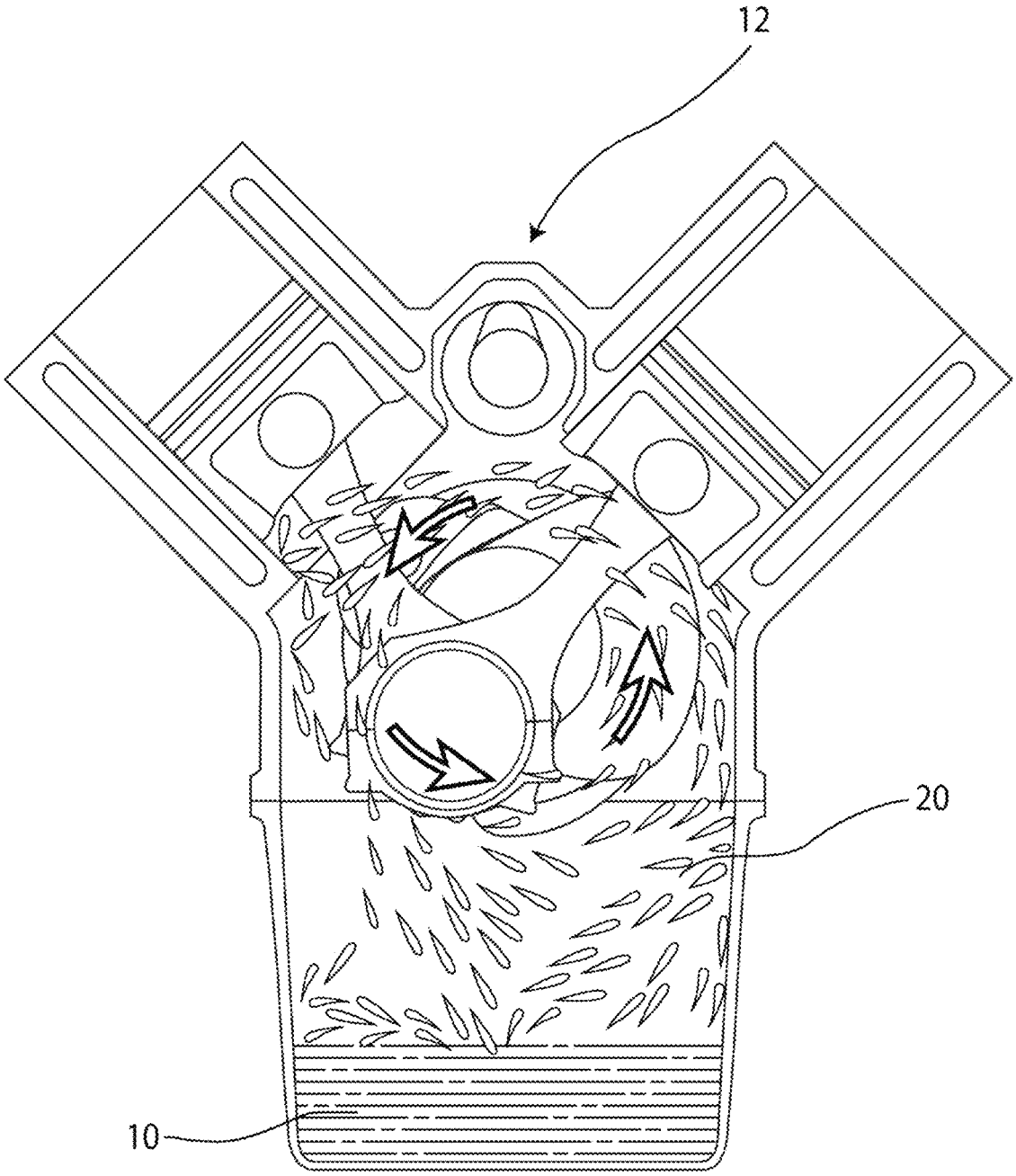
FIG. 1 (Prior Art)
FIG. 1 is an engine cross sectional view illustrative of the prior art.

It is to be understood that the embodiments of the invention described herein are not limited to particular variations set forth herein as various changes or modifications may be made to the embodiments of the invention described and equivalents may be substituted without departing from the spirit and scope of the embodiments of the invention. As will be apparent to those of skill in the art upon reading this disclosure, each of the individual embodiments described and illustrated herein has discrete components and features that may be readily separated from or combined with the features of any of the other several embodiments without departing from the scope or spirit of the embodiments of the present invention. In addition, many modifications may be made to adapt a particular situation, material, composition of matter, process, process act(s) or step(s) to the objective(s), spirit or scope of the embodiments of the present invention. All such modifications are intended to be within the scope of the invention.

Additionally, the separation of various system components in the implementations described herein should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

It will also be understood that, although the terms first, second, etc. may be used herein to describe various elements, these elements should not be limited by these terms. These terms are only used to distinguish one element from another. Thus, a first element could be termed a second element without departing from the teachings of the present invention.

Some embodiments have been described in connection with the accompanying drawings. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

All existing subject matter mentioned herein (e.g., publications, patents, patent applications and hardware) is incorporated by reference herein in its entirety except insofar as the subject matter may conflict with that of the present invention (in which case what is present herein shall prevail). U.S. Pat. No. 10,934,904 to Banks III, filed Jul. 3, 2020, is incorporated by reference in its entirety for all purposes.

Figure 4:
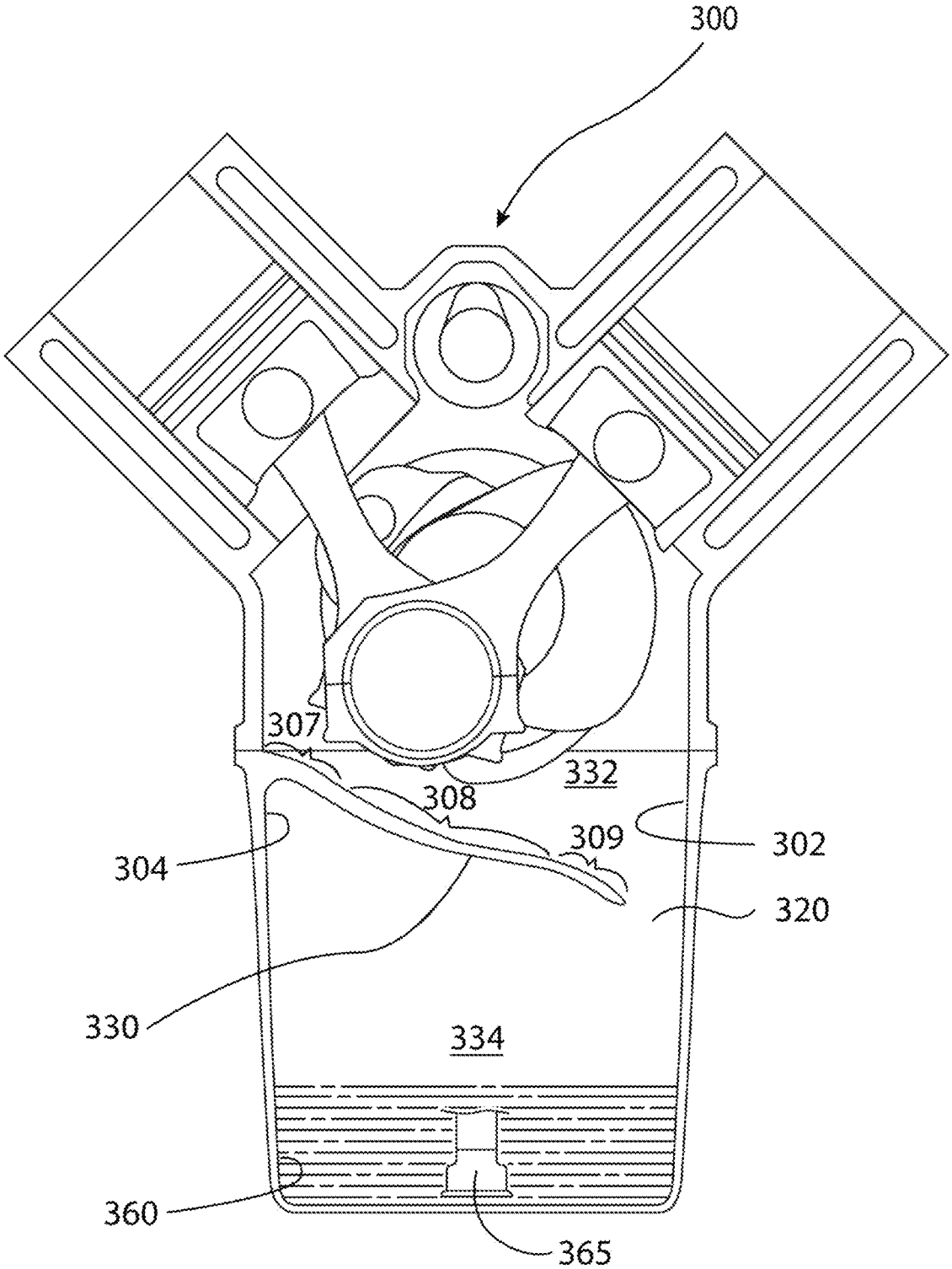
FIG. 4 is an engine cross sectional view in accordance with an embodiment of the invention.

Now, with reference to FIG. 4, a new system 300 for controlling oil aeration in an engine in accordance with embodiments of the invention is shown. The system 300 includes a first side wall 302 and a second side wall 304 opposite the first side wall. The system further includes an oil accumulation ramp 330 that extends downwards from the second side wall 304 all the way to the first side wall 302. The ramp 330 serves as a divider or barrier separating the crankcase region 332 from the lower oil region in the sump 334, thus minimizing the disturbance and aeration generated by the crankcase region to the oil in the sump.

The ramp 330 is shown generally sloping downward, dropping in elevation from the second wall 304 to the first wall 302. In the embodiment shown in FIG. 4, the ramp comprises three (3) different contiguous portions or regions. Each portion is shown having a different slope. First portion 307 has an initial relatively steep slope ranging from 30-90 degrees, and more preferably from 50-70 degrees. Second portion 308 has a shallow or minor slope less than 10, and in some embodiments less than 5 degrees. Third portion 309 is characterized as a drop off and has a slope greater than the slope of the second portion. In embodiments, the slope of the third portion 309 ranges from 10-60 degrees, and more preferably 30-50 degrees.

The system 300 shown in FIG. 4 also includes a sump entrance aperture 320 in the vicinity of the first wall 302. In embodiments, the aperture 320 is in the shape of an elongate slot, formed at the first wall 302. Centrifugal force and air velocity drives oil and air across the ramp 330 and into the entrance aperture 320, decelerating and directing the oil-air flow beneath the main plate 330 and into the chamber 334 below.

Figure 5:
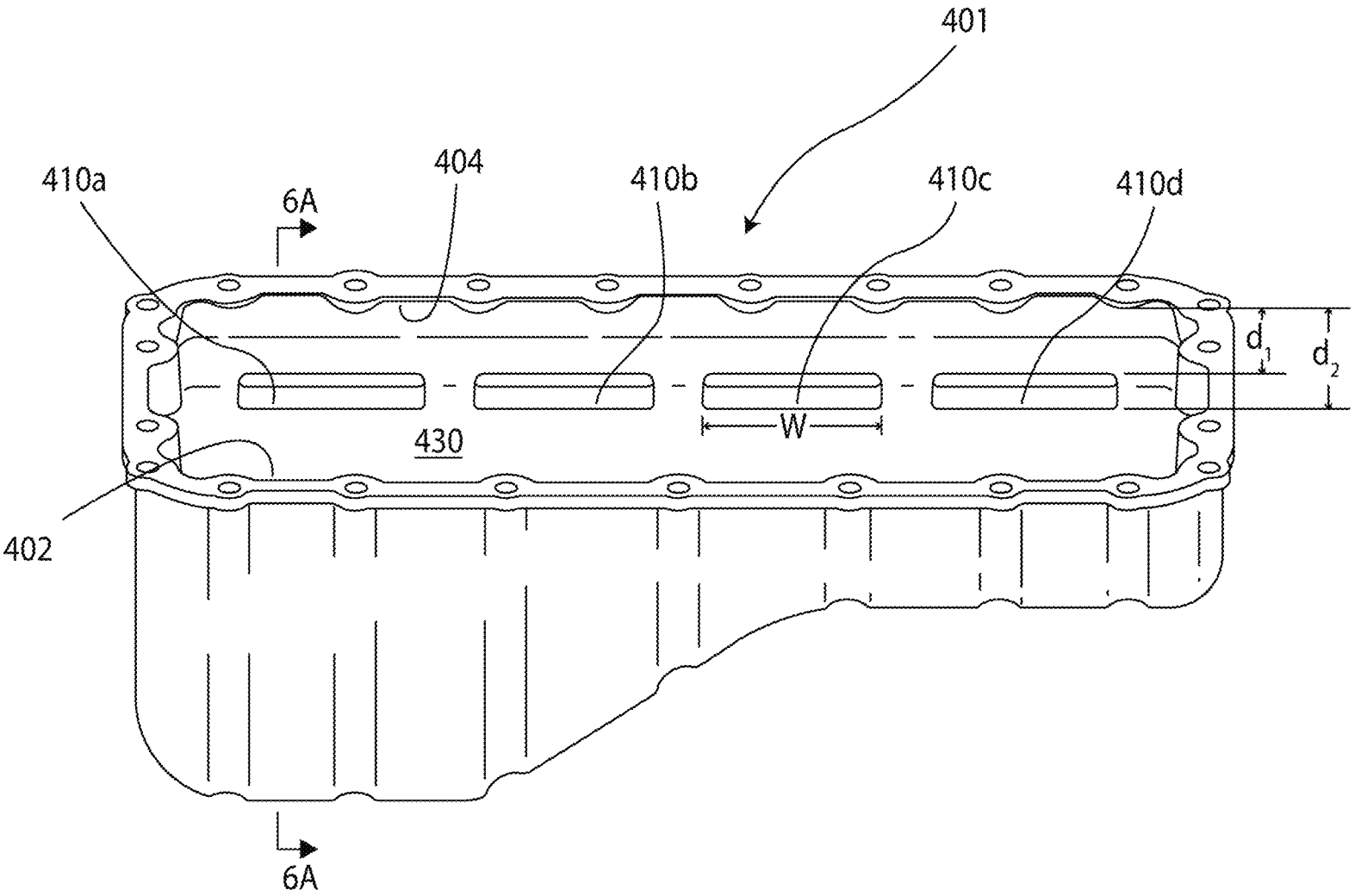
FIG. 5 is a top perspective view of an oil pan in accordance with another embodiment of the invention.
Figure 6A:
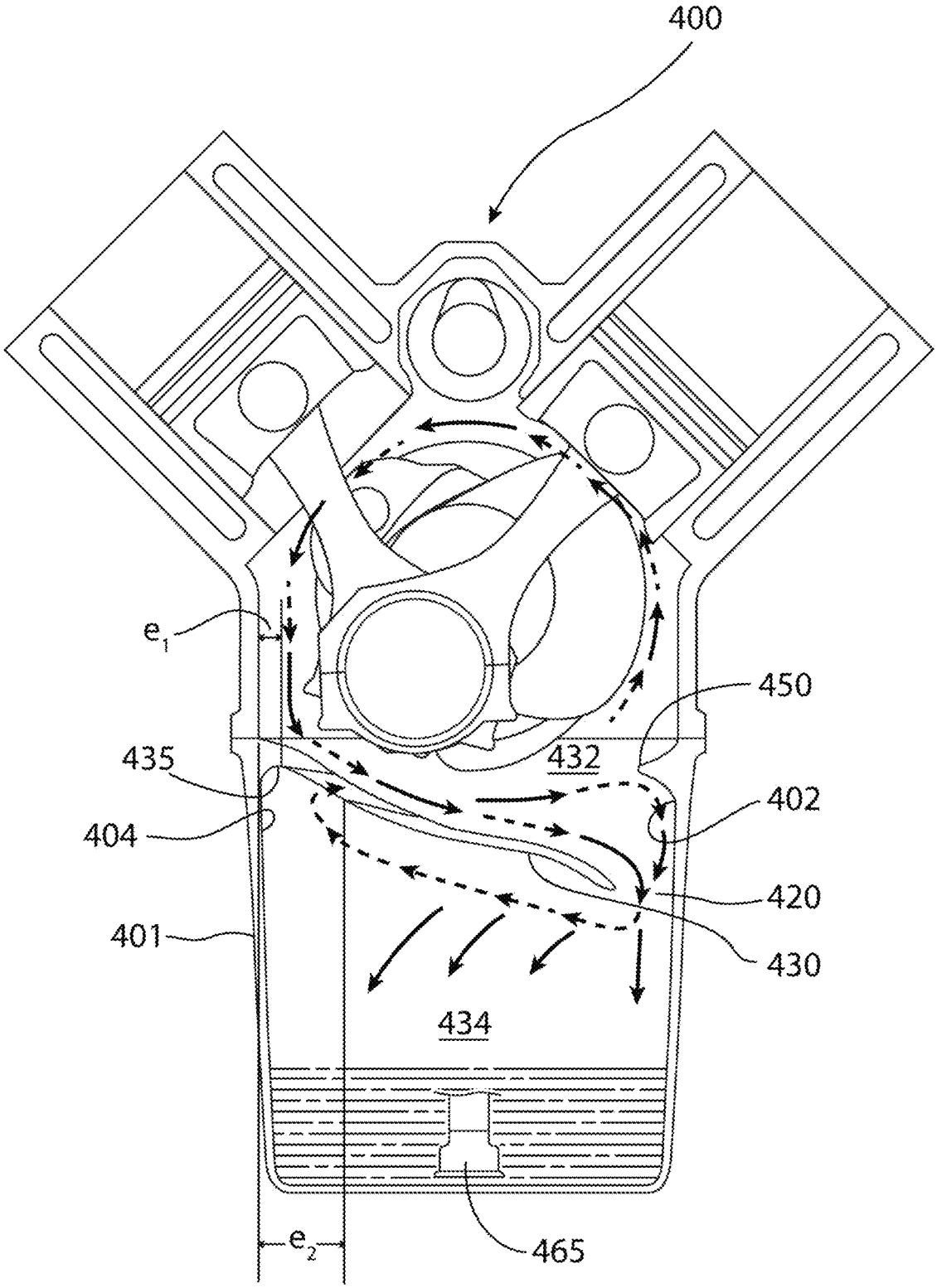
FIG. 6A is a sectional view of the oil pan shown in FIG. 5 combined with an engine cranktrain/crankcase taken along line 6A-6A in accordance with an embodiment of the invention.

FIGS. 5-6A illustrate another oil control system 400 in accordance with embodiments of the invention. Similar to the system 300 described above, system 400 includes a first side wall 402 and a second side wall 404 opposite the first side wall. The system further includes an oil accumulation ramp 430 that extends downwards from the second side wall 404, ending near the first side wall 402. The ramp has a gentle slope downward ranging from 30-60 degrees, and is curved. The ramp shown in FIG. 6A has two inflection points including a first upward concave curvature followed by a downward convex curvature closer to the first side wall 402. In a sense, the ramp 430 has an eyebrow-like shape or appearance.

The ramp 430 serves as a barrier separating the crankcase region 432 from the lower oil region in the sump 434, thus minimizing the disturbance and aeration generated by the crankcase region to the oil in the sump.

The system 400 shown in FIG. 6A also includes a sump entrance aperture 420 in the vicinity of the first wall 402. In embodiments, the aperture 420 is in the shape of an elongate slot, formed at the first wall 402. Centrifugal force and air velocity drives oil and air across the ramp 430 and into the entrance aperture 420, decelerating and directing the oil-air flow beneath the main plate 430 and into the chamber 434 below.

The system 400 shown in FIGS. 5-6A includes a couple of different features than the system 300 described above. For example, instead of a continuous (hole-free) ramp 330, the ramp 430 of system 400 includes a plurality of continuous narrow ports or passageways 410*a*, 410*b*, 410*c*, 410*d* extending through the ramp 430. The ports or passageways serve to return air from the oil sump to the crankcase region 432 while maintaining the oil in the sump 434, as well as maintaining higher pressure in the oil sump. Moving air from the crankcase to the sump and returning air in this manner improves the performance of the engine and lubricating oil without incurring the parasitic losses and increased aeration associated with the use of impact devices. Additionally, providing a higher pressure in the sump reduces pump inlet cavitation and reduces the work required by the oil pump, further reducing parasitic engine losses.

The shape and number of air return ports 410 through the ramp 430 may vary. In embodiments, 2-10 air return ports are provided, and more preferably, 3-6 air return ports are provided. In embodiments, each port has an identical cross section. For example, and without limitation, each port can have a smooth elongate slot or rectangular cross section with a height ranging from 0.5 to 1 in, and a width (W) ranging from 3 to 5 in., and a passageway length ranging from 0.25 to 1 in. In other embodiments, the air return ports differ from one another.

In the embodiment shown in FIGS. 5-6A, the entrance to the port 410*a* commences at distances e1, e2 from the second wall 404 wherein e1 ranges from 0.5 to 1 in., and e2 ranges from 1 to 3 in. The port 410*d* is shown extending through the wall 430 to distances d1, d2 from the second wall 404 wherein d1 ranges from 2 to 4 in., and d2 ranges from 3 to 5 in. The contiguous uninterrupted arrangement between ramp 430 and sidewall 404 creates a smooth airflow director 435 for guiding air across the top of the ramp 430. Oil droplets arising from the oil sump fall out, and are gravity fed back into the oil reservoir.

By setting (or tuning) the number, arrangement, and shape of the slots, oil and air flow are optimized. Additionally, the inventors have found that the ratio ($R_1$) of the cross sectional area of the air return ports (collectively) to the oil entrance aperture 420 is a useful parameter to tune. In the embodiment shown in FIGS. 5-6A, the ratio ($R_1$) ranges from 1/10 to 1/1, and in some embodiments, ¼ to ¾.

Figure 2:
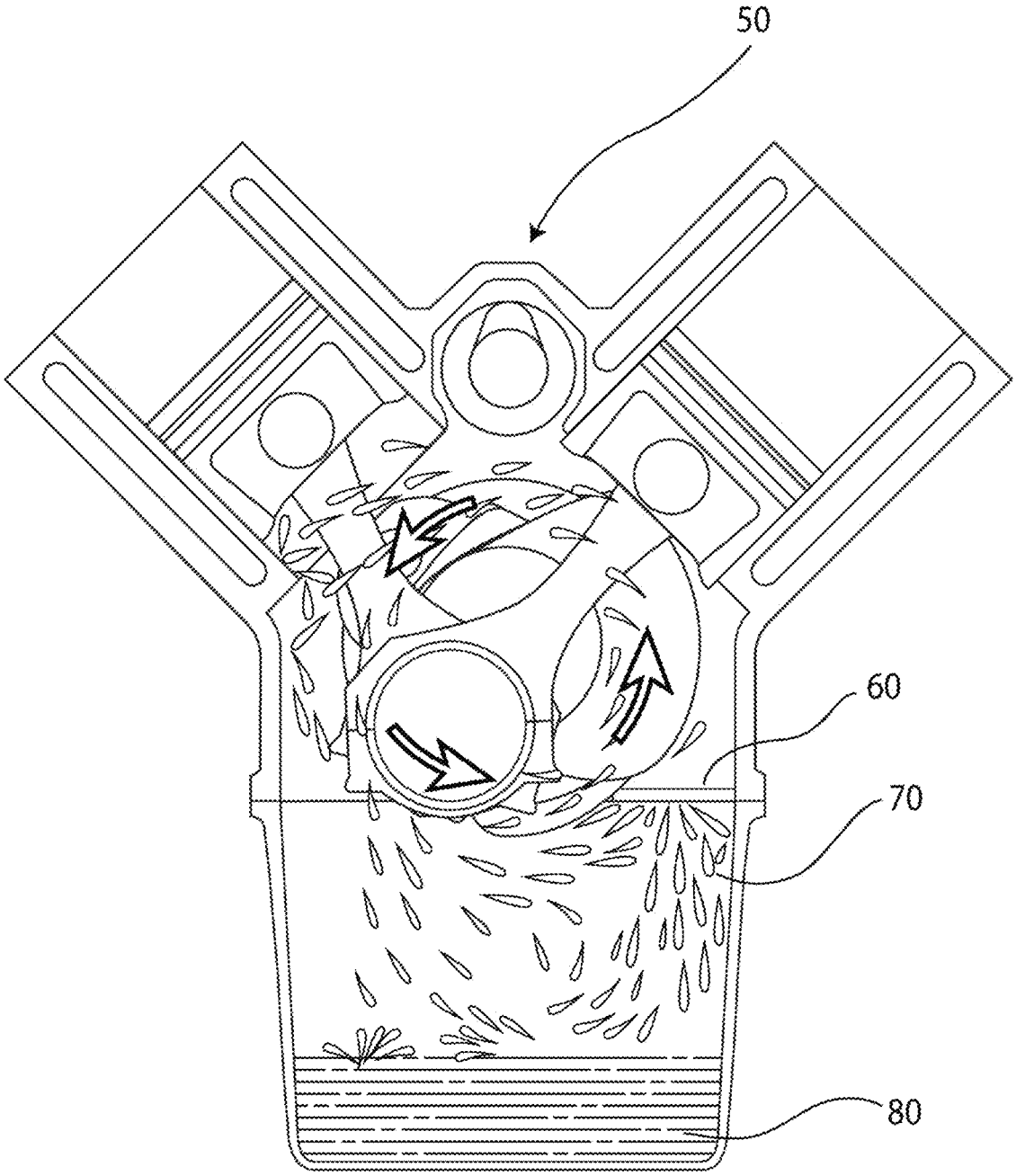
FIG. 2 (Prior Art)
FIG. 2 is an engine cross sectional view with a crankshaft scraper illustrative of the prior art.

The system 400 shown in FIG. 6A also includes a divisor 450 protruding from the first side wall 402. In embodiments, the divisor 450 is a passive device for smoothly directing oil entrained in the crankcase region 432 into the sump region 434. The divisor is shown having an upward facing concave face above and a downward facing concave face below (somewhat of an 'arrowhead' shape), so shaped to encourage smooth flow of air and oil. It is distinguished from a crankshaft scraper (e.g., the scrapper 60 shown in FIG. 2) because the divisor does not include an impact surface.

The length of the divisor may vary. In embodiments, the divisor extends along the first side wall for the length of the oil pan, or at least for a length sufficient to match the size of the sump entrance aperture. In embodiments, the height of the divisor 450 ranges from 0.5 to 1.5 in. from the side wall.

Optionally, and with reference to FIG. 5, the system 400 is a one-piece oil pan 401 including the oil sump, ramp and divisor. Alternatively, the system may comprise a plurality of components interconnected to collectively form the system 400 described herein. For example, in embodiments, the system comprises an oil sump or oil pan, and a separable midpan that is adapted to be fastened to the crankcase and to the lower oil pan.

Figure 6B:
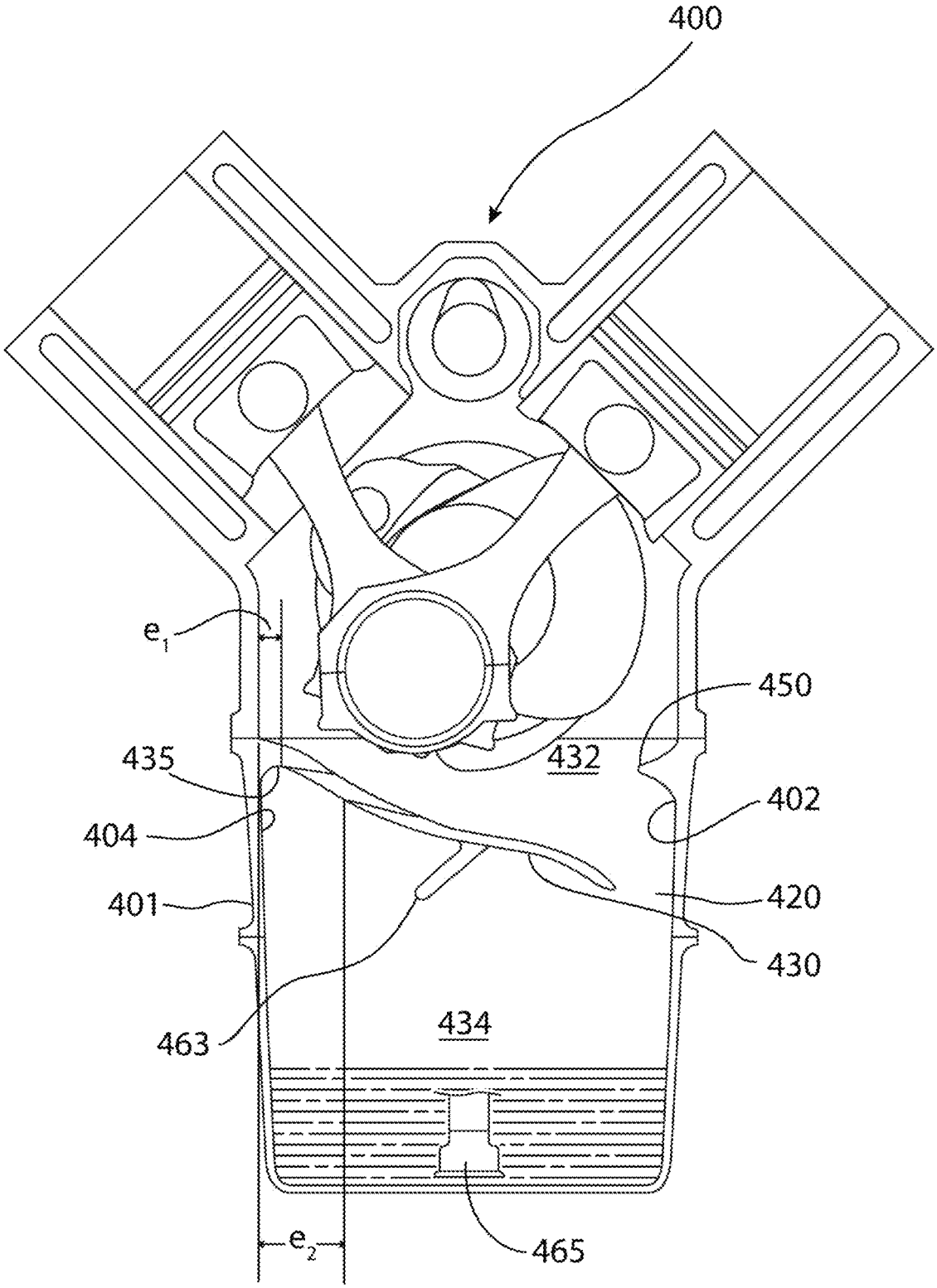
FIGS. 6B-6D are sectional views of oil pans combined with an engine cranktrain/crankcases in accordance with various embodiments of the invention.

FIG. 6B is another embodiment of invention similar to the system 400 shown in FIG. 6A except that the system shown in FIG. 6B also includes an oil air deflector 463. Deflector 463 serves to deflect oil and air into the sump and make the oil air separation more complete. It serves to force contact between the oil/air mist and the oil pool in the sump such that the oil droplets in the mist are encouraged to fall out of the mist by gravity and surface tension forces. Although deflector 463 is shown extending substantially perpendicular to the ramp 430, it may extend at other angles. The length of the deflector may vary. In embodiments, the length of the deflector may range from 1 to 3 in.

Figure 6C:
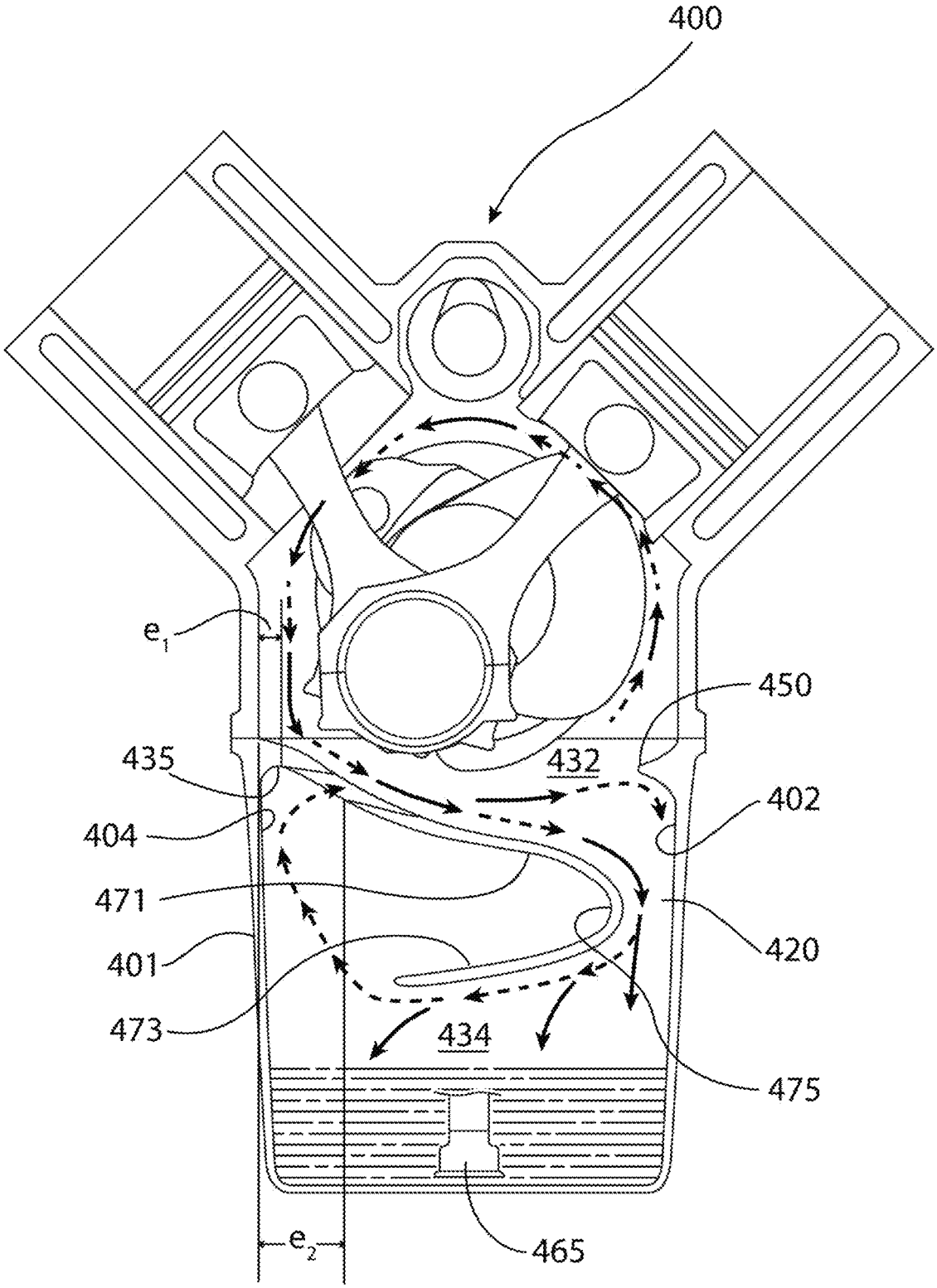

FIG. 6C illustrates another oil control system in accordance with embodiments of the invention. Similar to the system described above, system 400 includes a first side wall 402 and a second side wall 404 opposite the first side wall, and a ramp 471 extending from the second side wall towards the first side wall. However, the oil accumulation ramp 471 shown in FIG. 6C additionally comprises a lower portion or flap 473 and convex region 475. The flap 473 extends from the convex region 475 towards the second wall 404 and downward towards the bottom of the sump 434. This configuration enhances oil separation by forcing contact between the oil/air mist and the oil pool in the sump such that the oil droplets in the mist are encouraged to fall out of the mist by gravity and surface tension forces.

Additionally, the convex region 475 enhances air oil separation and reduced aerodynamic drag by taking advantage of the Coanda effect, by which high velocity air from the air return ports and crankcase will tend to adhere closely to the ramp surface and follow the surface curvature into the sump 434. As the lower mass air remains attached to the surface, higher mass oil will tend to separate from the air and fall out into the oil sump 434.

In embodiments, a radius of curvature of the convex region 475 ranges from 1 to 4 in. In embodiments, the distance between the oil level and the bottom of the lower ramp/flap portion 473 ranges from 0.5 to 2 in. In embodiments, the spacing between the end of the lower ramp/flap portion 473 and the second wall 404 ranges from 1.5 to 4 in.

Figure 6D:
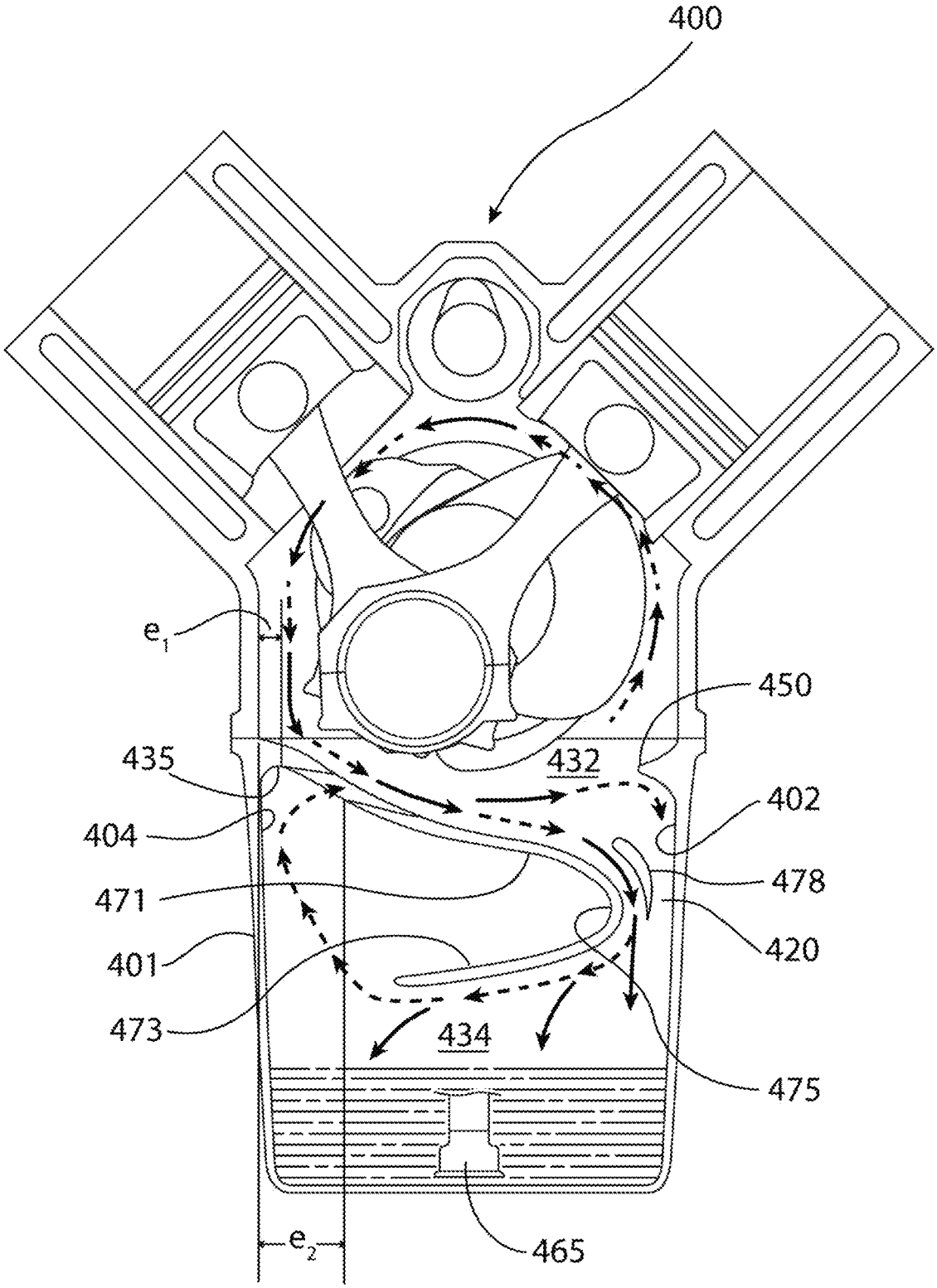

FIG. 6D illustrates another oil control system in accordance with embodiments of the invention. Similar to the system described above, system 400 includes a first side wall 402 and a second side wall 404 opposite the first side wall, and a ramp 471 extending from the second side wall towards the first side wall. However, the system additionally comprises a slat 478 at the entrance aperture 420.

The slat is shown having a convex curvature to match the curvature of the region 475 of the ramp. The thickness of the slat may be similar to the thickness of the ramp. Optionally, the slat includes a slight taper in the downward direction. The length of the slat may vary. In embodiments, the length of the slat ranges from 1 to 3 in.

The slat 478 cooperates with the ramp to both encourage flow attachment nearest the ramp (e.g., region 475), as well as to assist with turning flow entering from the divisor 450 in the same direction.

Figure 7:
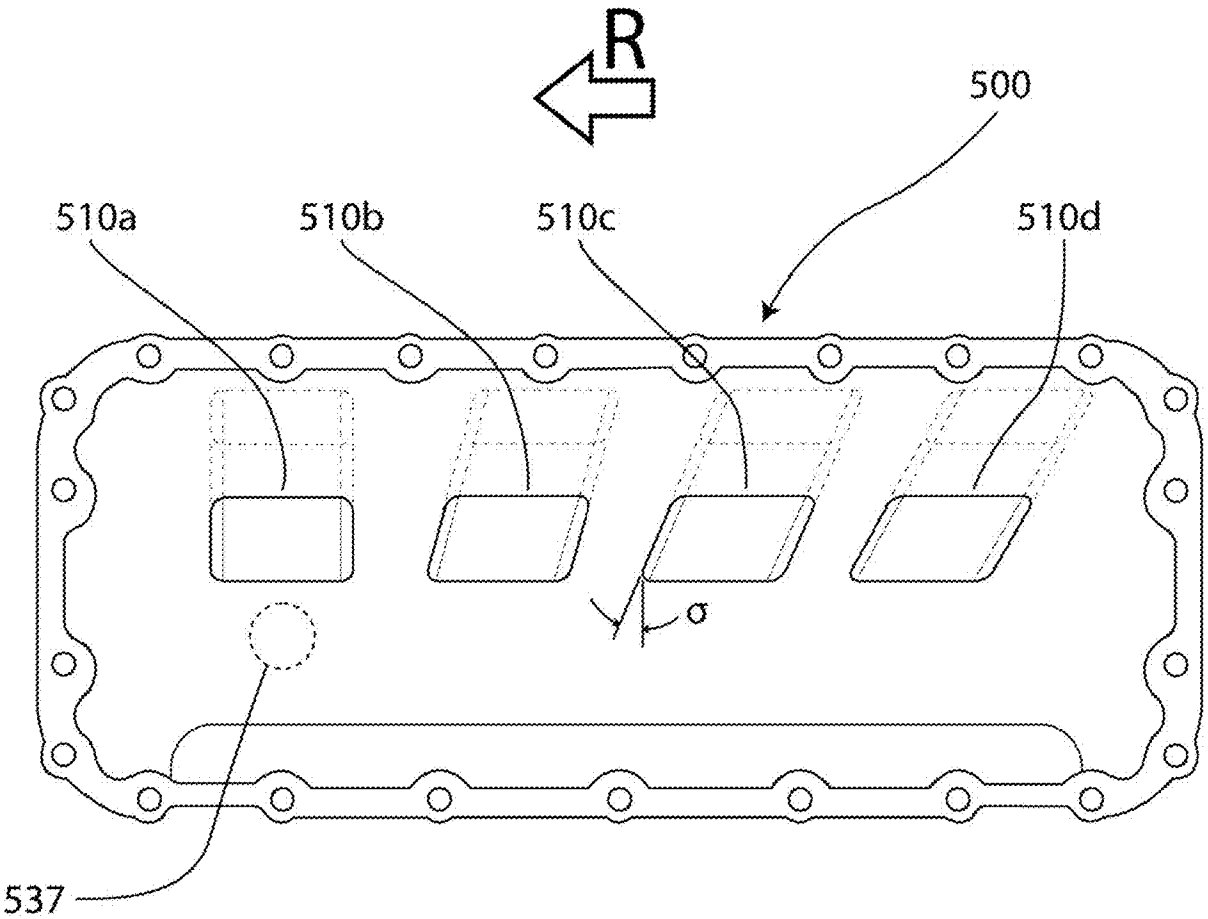
FIGS. 7-9 are top views of oil pans in accordance with various embodiments of the invention.

In some embodiments, and with reference to FIG. 7, one or more of the air return ports 510*b*, 510*c*, 510*d* are aimed or angled relative to the median plane by an angle (σ). By median plane, it is meant the plane extending from the left side to right side, and perpendicular to a plane extending from the front to the rear (R). The flow is intended to be directed towards the base of the oil sump which typically lies rearward (R) where the oil enters an opening leading to the oil pump (hereinafter referred to as the "oil pump pickup") 537 and rerouted to the oil pump and to the engine. In embodiments, one or more of the air return ports 510*b*, 510*c*, and 510*d* are angled (σ) from 5 to 45 degrees, and more preferably 5 to 10 degrees, towards the base of the oil sump and oil pump pickup 537. Port 510*a* is not angled because it is located directly above the base of the oil sump—there is no advantage to angling port 510*a*.

Figure 8:
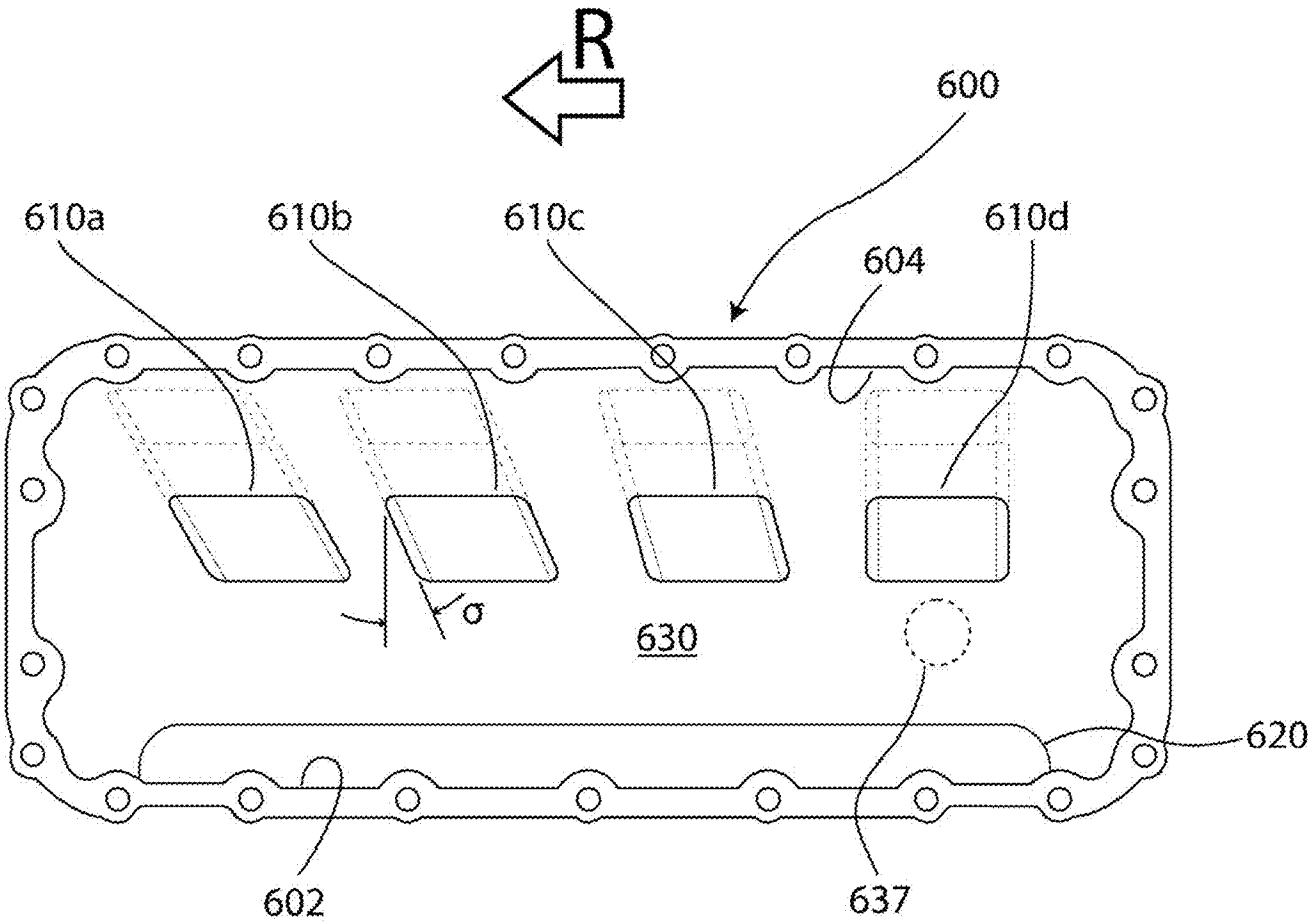

FIG. 8 illustrates another oil control system 600 having vectored airflow in accordance with embodiments of the invention. Similar to the system 500 described above, system 600 includes a first side wall 602, a second side wall 604 opposite the first side wall, and an oil accumulation ramp 630 that extends downwards from the second side wall all the way to the first side wall. System 600 also includes a sump entrance aperture 620 in the vicinity of the first wall 602, and a plurality of continuous narrow air return ports or passageways 610*a*, 610*b*, 610*c*, 610*d* extending through the ramp 630, and for directing air out of the oil sump while maintaining the oil in the sump, as well as maintaining higher pressure in the oil sump.

The air return ports 610*a*, 610*b*, 610*c*, 610*d*, however, are arranged at different angles (σ) than the air return ports shown in FIG. 7. In particular, the air return ports 610*a*, 610*b*, 610*c* are angled to direct flow towards the front of the engine where, in this embodiment, the oil pump pickup 637 is located. Port 610*d* is not angled because it is located directly above the base of the oil sump and already aimed at the oil pump pickup 637—there is no advantage to angling port 610*d*.

Figure 9:
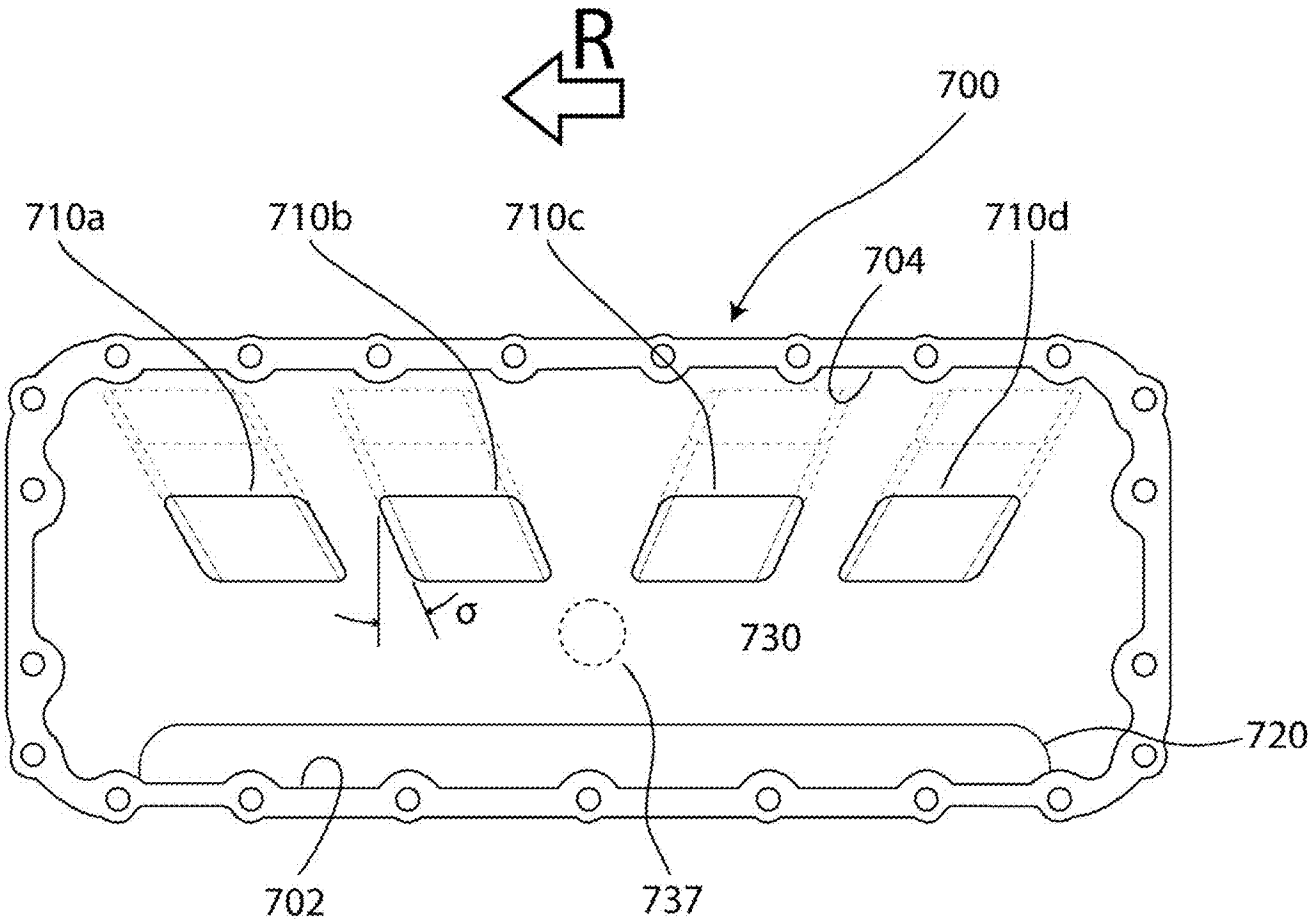

FIG. 9 illustrates another oil control system 700 in accordance with embodiments of the invention. Similar to the system 500 described above, system 700 includes a first side wall 702, a second side wall 704 opposite the first side wall, and an oil accumulation ramp 730 that extends downwards from the second side wall all the way to the first side wall. System 700 also includes a sump entrance aperture 720 in the vicinity of the first wall 702, and a plurality of continuous narrow air return ports or passageways 710*a*, 710*b*, 710*c*, 710*d* extending through the ramp 730, and for directing air out of the oil sump while maintaining the oil in the sump, as well as maintaining higher pressure in the oil sump.

The air return ports 710*a*, 710*b*, 710*c*, 710*d*, however, are arranged at different angles (σ) than the air return ports shown in FIG. 7. In particular, the air return ports 710*a*, 710*b* are angled forward to direct flow towards the middle of the engine where, in this embodiment, the oil pump pickup 737 is located. Air return ports 710*c*, 710*d* are angled rearward (R) to direct flow towards the middle of the engine where the oil pump pickup 737 is located.

The magnitude (or degree) of the angle (σ) for vectoring the air flow for each port may vary. In embodiments, the magnitude of the angles varies based on the longitudinal distance from the oil pump pickup 737. Air return ports further from the oil pump pickup have a greater (σ) than air return ports closer to the oil pump pickup 737. For example, in another embodiment not shown, port 710*c* may have an angle ranging 5-10 degrees, whereas port 710*d* may have an angle ranging from 15-20 degrees.

The arrangement and shape of the air return ports (namely, the tuning) as described herein serves to optimally direct air out of the oil sump while maintaining the oil in the sump, as well as maintain higher pressure in the oil sump. Moving air from the crankcase to the sump and returning air in this manner improves the performance of the engine and lubricating oil without incurring the parasitic losses and increased aeration associated with the use of impact devices. Additionally, providing a higher pressure in the sump reduces the work required by the oil pump, further reducing parasitic engine losses.

Figure 10:
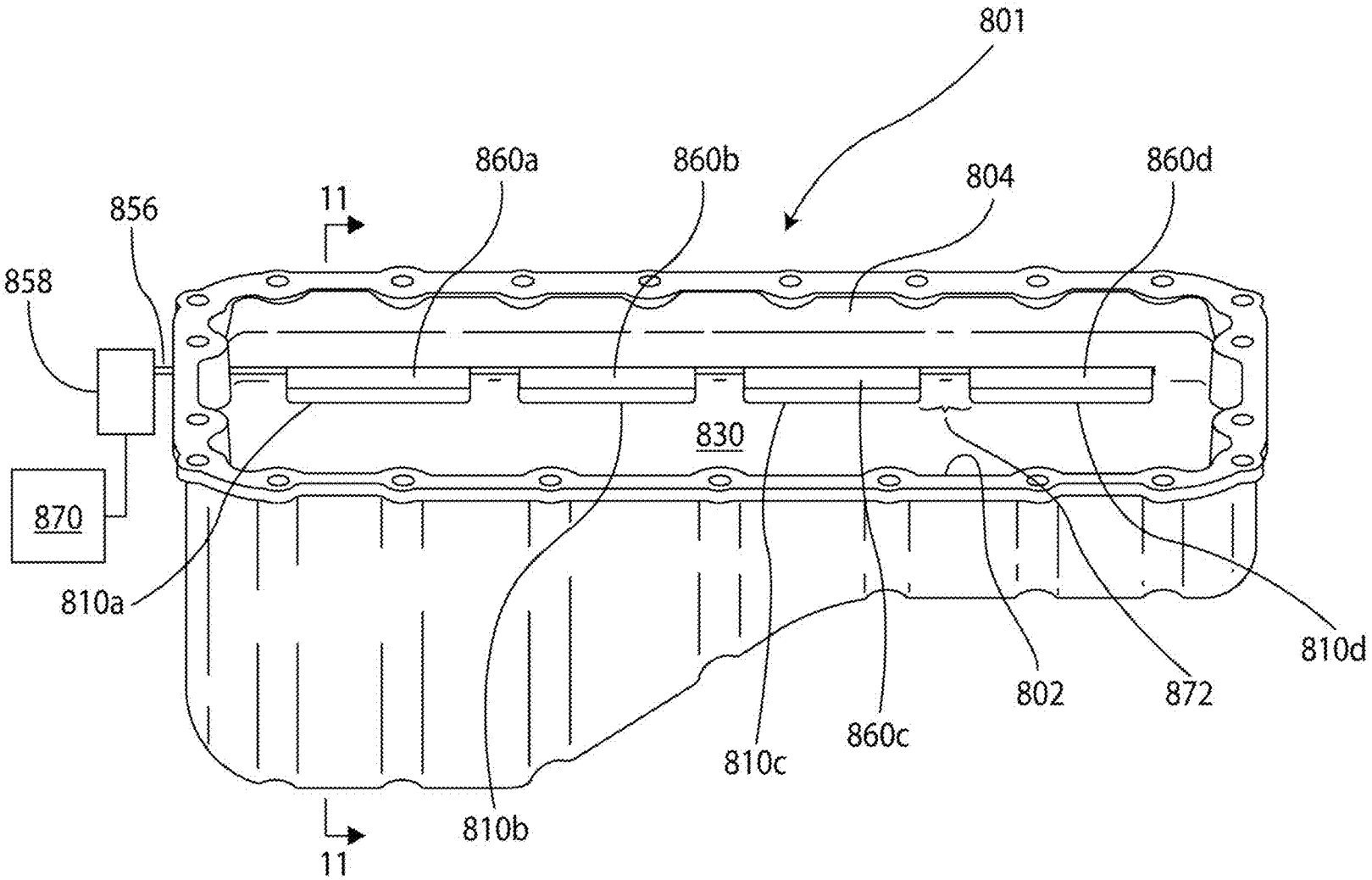
FIG. 10 is a top perspective view of an oil pan in accordance with another embodiment of the invention.
Figure 11:
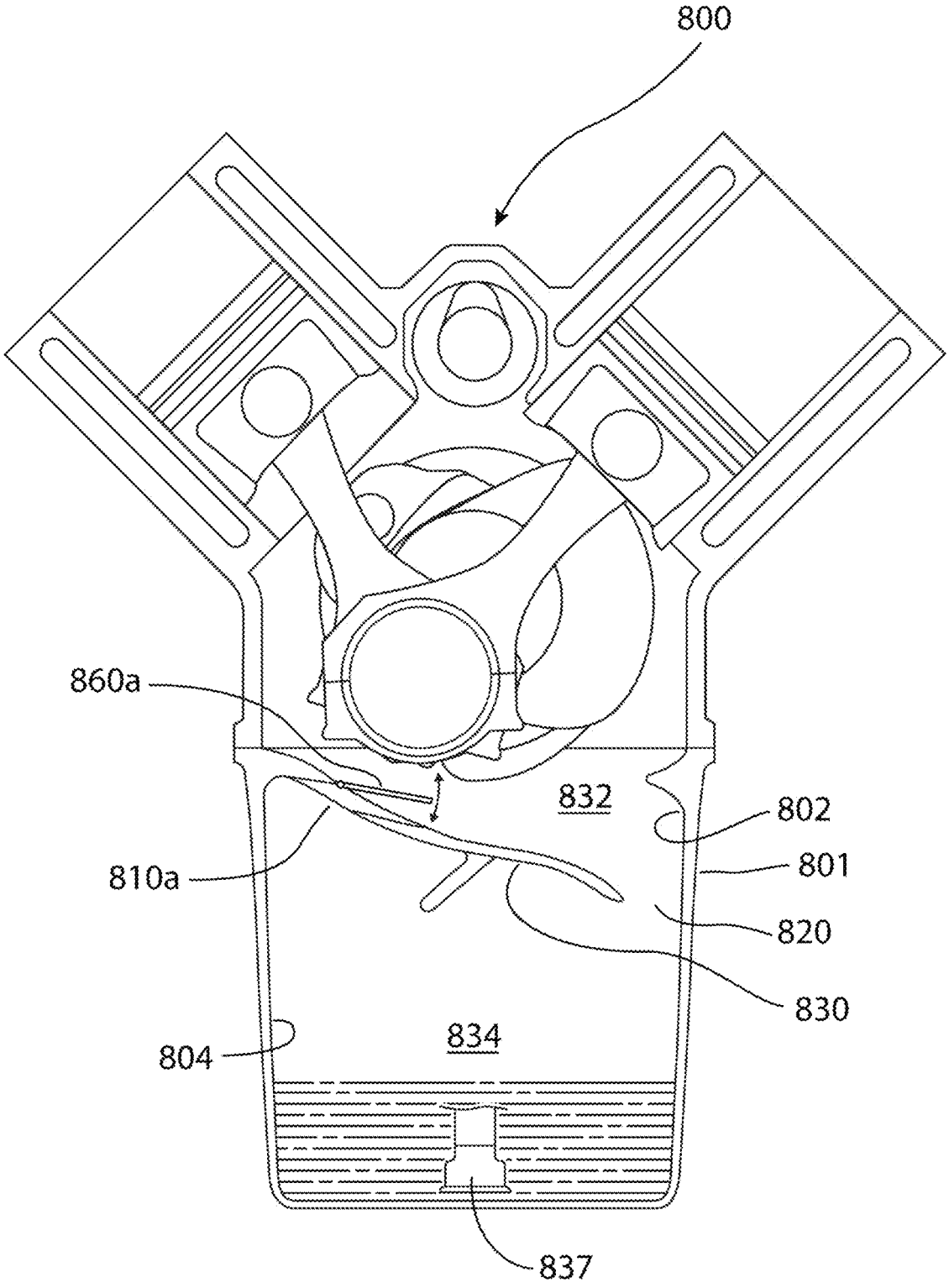
FIG. 11 is a sectional view of the oil pan shown in FIG. 10 combined with an engine cranktrain taken along line 11-11 in accordance with an embodiment of the invention.

FIGS. 10-11 illustrate another oil control system 800 and oil pan 801 in accordance with embodiments of the invention. Similar to the system 400 described above, system 800 includes a first side wall 802 and a second side wall 804 opposite the first side wall. The system further includes an oil accumulation ramp 830 that extends downwards from the second side wall 804 all the way to the first side wall 802. The ramp can have a curvature and downward slope similar to the embodiments described herein.

The ramp 830 serves as a divider or barrier separating the crankcase region 832 from the lower oil region in the sump 834, thus minimizing the disturbance and aeration generated by the crankcase region to the oil in the sump.

The system 800 shown in FIGS. 10-11 also includes a sump entrance aperture 820 in the vicinity of the first wall 802. In embodiments, the aperture 820 is in the shape of an elongate slot extending from the front to the rear, and formed along the first wall 802. Centrifugal force and air velocity drives oil and air across the ramp 830 and into the entrance aperture 820, decelerating and directing the oil-air flow beneath the main plate 830 and into the chamber 834 below.

The system 800 shown in FIGS. 10-11 also includes a plurality of continuous narrow air return ports or passageways 810*a, b, c, d* extending through the ramp 830, and for directing air out of the oil sump while maintaining the oil in the sump, as well as maintaining higher pressure in the oil sump. Moving air from the crankcase to the sump and returning air in this manner improves the performance of the engine and lubricating oil without incurring the parasitic losses and increased aeration associated with the use of impact devices. Additionally, providing a higher pressure in the sump reduces pump inlet cavitation and reduces the work required by the oil pump, further reducing parasitic engine losses.

The number of air return ports through the ramp can vary. In embodiments, the number of air return ports ranges from 1-8, frequently 3-6, or optionally equals the number of crankshaft bays of the engine.

Islands or bridges (e.g., 872) separate adjacent ports (e.g., 810*c*, 810*d*). The islands or bridges aid in defining airflow vectoring, whether the airflow is aimed at an angle (or straight) as a discrete airflow jet(s) into the entrance aperture 820 along the first side wall 802, described herein. In embodiments, the islands or bridges 872 have a minimum distance ranging from the 0.2 to 1.5 in.

The shape of the air return ports may also vary. In embodiments, the cross section of the air return ports is rectangular or slot-like. However, the cross sectional shape may also be round or obround.

The oil pan assembly 801 shown in FIGS. 10-11 additional comprises a throttling device, such as cover or flap 860*a*, 860*b*, 860*c*, 860*d* to adjust the size of the outlet of each of the slots 810*a*, 810*b*, 810*c*, and 810*d* respectively. Controlling the size of the air return port outlet(s) serve to control velocity therethrough as well as pressure in the sump 834, and consequently regulate residence time of air in the sump region 834 to optimize separation of oil from air. Residence time is the time required for air to cross the sump region before being returned to the crankcase region. Increased residence allows time for oil to separate or 'fall out' from the air stream passing through the sump region.

An advantage of the design shown in FIGS. 10-11 is that the velocity and pressure can be adjusted in the system for different operating conditions by adjusting the size of the outlet of the air return ports. Examples of varying operating conditions include high engine speed and low engine speed. The ports may also be varied as a function of other engine parameters including oil pressure, oil temperature, and others. In particular embodiments, the size of the outlet of the air return ports are varied in proportion to engine speed. In some embodiments, the size of the outlets of the air return ports are adjusted to maintain a constant velocity and constant pressure in the system so as to reduce parasitic losses in the engine.

Optionally, the adjustment is in real time and based on feedback arising from the engine such as, for example, engine speed (e.g., RPM) or other parameters. In embodiments, when a change in engine speed is detected, a port throttle control electronic module 870 (operable with a motor 858) is programmed and operable to automatically adjust the throttle to the port(s) by rotating the cover about an axle or shaft 856. The port throttle control module may operate the port throttles in proportional response to changes in one or multiple parameters as defined by calibration software.

The arrangement and shape of the air return ports (namely, the tuning) as described herein serves to optimally direct air out of the oil sump while maintaining the oil in the sump, as well as maintain higher pressure in the oil sump. Moving air from the crankcase to the sump and returning air in this manner improves the performance of the engine and lubricating oil without incurring the parasitic losses and increased aeration associated with the use of impact devices. Additionally, providing a higher pressure in the sump reduces pump inlet cavitation and reduces the work required by the oil pump, further reducing parasitic engine losses.

Figure 12:
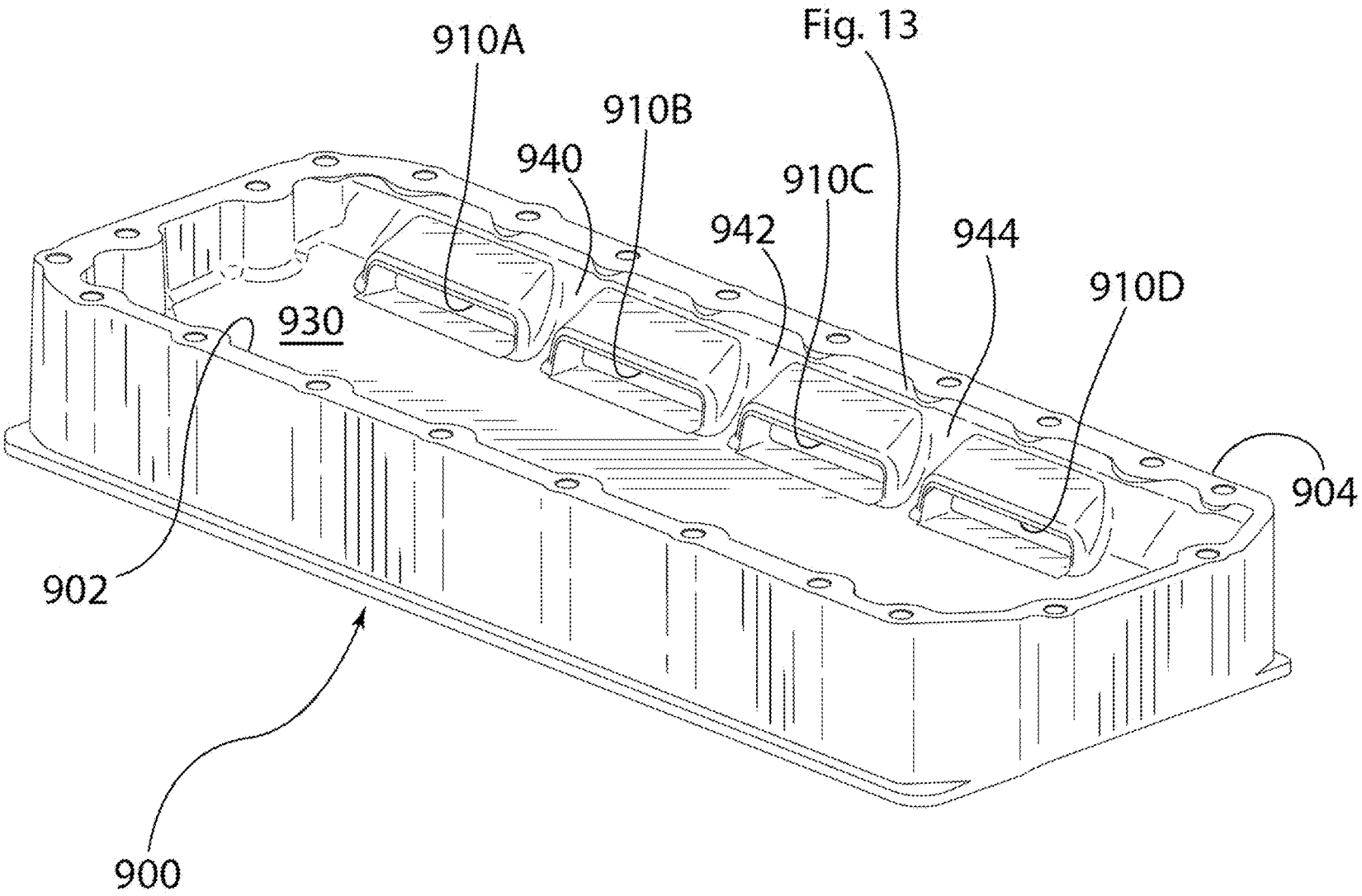
FIG. 12 is a top perspective view of an oil pan in accordance with another embodiment of the invention.

FIG. 12 is a top perspective view of an oil pan 900 in accordance with another embodiment of the invention. Similar to the system 500 described above, system 900 includes a first side wall 902, a second side wall 904 opposite the first side wall, and an oil accumulation ramp 930 that extends downwards from the second side wall all the way to the first side wall. System 900 also includes a plurality of continuous narrow air return ports or passageways 910*a*, 910*b*, 910*c*, 910*d* and flow delineators 940, 942, 944 incorporated into the ramp 930, and for directing and organizing air out of the oil sump while maintaining the oil in the sump, as well as maintaining higher pressure in the oil sump.

For the embodiment shown in FIG. 12, three flow delineators 940, 942, 944 are arranged at the longitudinal location (along the crankshaft axis) corresponding to each of the engine's main bearing bulkheads (not shown). The flow delineators serve to discretize the ports (e.g., 910*a*, 910*b*, 910*c*, 910*d*) and obstruct the return airflow paths, thus vectoring the return airflow on a per-port basis. Discretizing air return ports through the use of flow delineators in the oil accumulation ramp reduces the profile of the material in the path of oil-air flow in the crankcase, further reducing aeration and aerodynamic drag.

Without intending to be bound to theory, the flow delineators have advantages based on the engine crankshaft anatomy. Crankshaft main bearing bulkheads form vertical walls within the crankcase. These walls are parallel to the medial plane, beginning below the crankshaft axis and extending upwards to meet the interior walls of the engine block. These discrete regions formed are referred to as crank bays and contain one to two piston and rod assemblies within them. Because the majority of the oil-air mixture circulating within the crankcase results from the motion of the crankshaft, rods, and pistons within these discrete crank bays, they are also the regions where the majority of oil is deposited onto the oil accumulation ramp. In embodiments, we aim the airflow jet(s) via the position of the ports (e.g., ports 910*c*, 910*d*) and flow delineators (e.g., flow delineator 944) to the areas corresponding to the crank bays and main bearing bulkheads, respectively, to create the most effective use of return airflow—the configuration focuses airflow where it will have maximum effect, namely, to drive oil from the ramp and into the sump. Additionally, by reducing the total air outlet area the velocity is maximized and thus more effective in driving oil from the ramp.

Additionally, for embodiments, flow delineators may be arranged on the sides of an air return port regardless of whether the flow delineator is between two adjacent air return ports.

Figure 13:
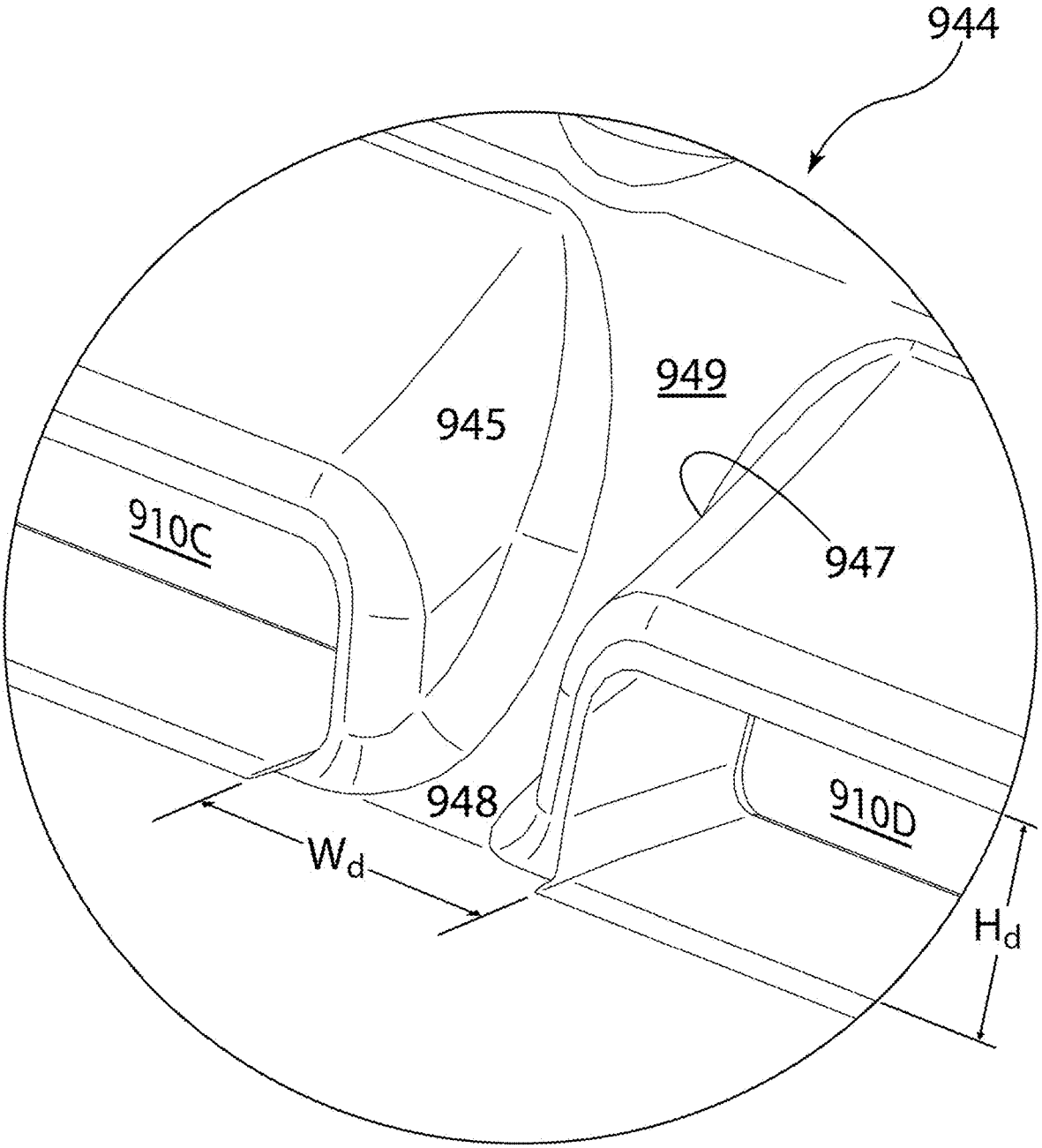
FIG. 13 is an enlarged view of inset shown in FIG. 12.

In embodiments, and with reference to FIG. 13, flow delineator 944 has an inward or depressed curvature set between two opposing walls 945, 947. In embodiments, the walls are vertical but in other embodiments, the walls have a different or varying orientation.

In embodiments, the shape is a depression and can be characterized by a width ($W_d$), height ($H_d$), valley portion 948, and a rear sloping portion 949. In embodiments, the width corresponds generally to the spacing or gap between the crank bays and can range from 0.2 to 1.5, and in some embodiments 0.8 to 1.2 inches. In embodiments, the height can range from 0.5 to 1 inches. In embodiments, the sloping rear wall has a curvature or slope that matches the slope or angle of the ramp 930.

The concave curvature of the depressed delineators provides for convex curvature on the opposite side at which the air enters. Convex curvature of the flow delineators at the air entrance provides for favorable flow dynamics. In embodiments this curvature may be extended along the passageway length by continuously curving the port sidewalls to achieve a converging nozzle geometry or to otherwise improve air discharge characteristics. Port sidewalls may also be curved along their vertical orientation to create an obround port sidewall form.

Figure 3:
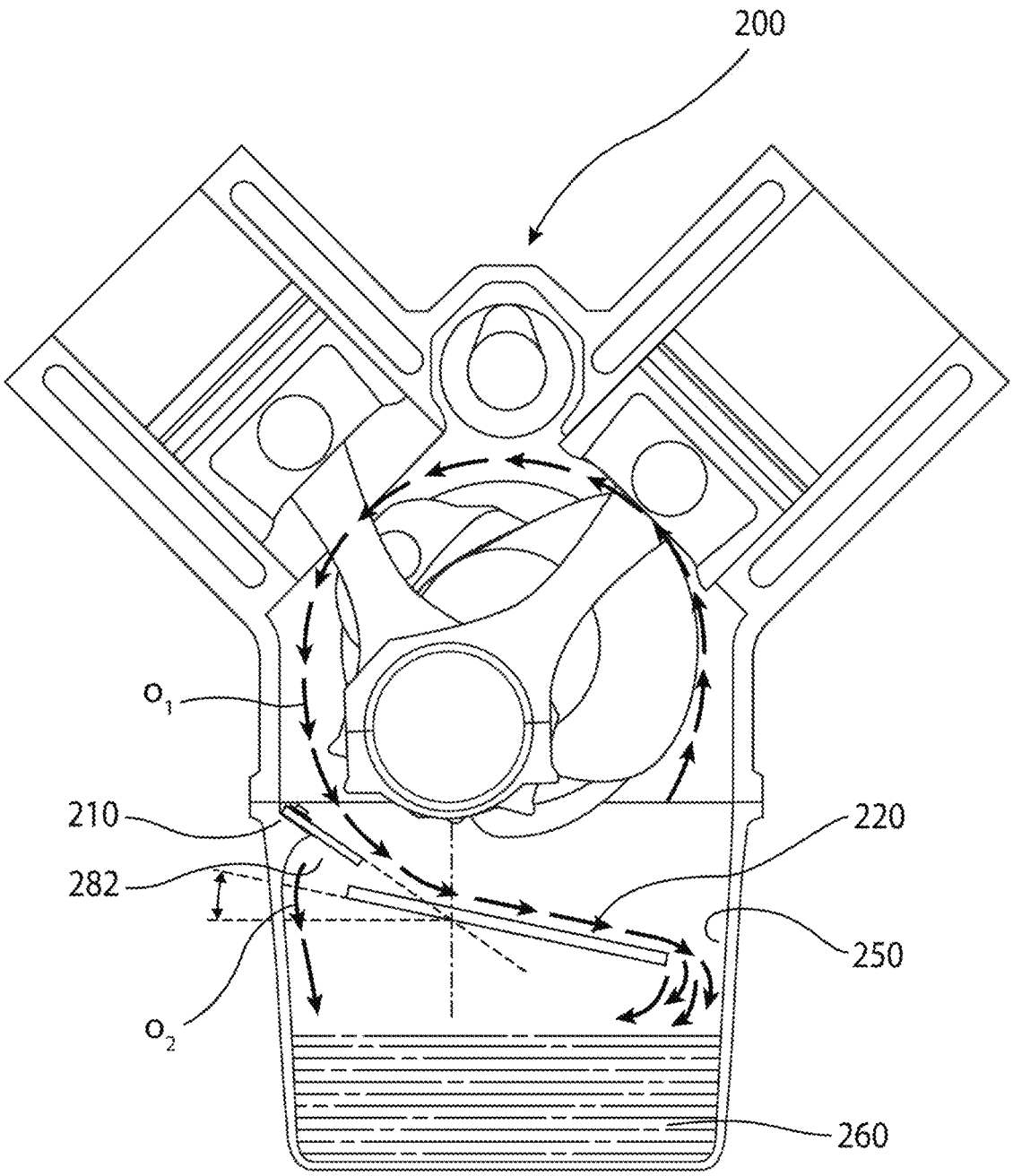
FIG. 3 (Prior Art)
FIG. 3 is an engine cross sectional view with a multi-plate design illustrative of the prior art.

Testing was performed to compare the prior art oil pan assembly as shown in FIG. 3 (hereinafter referred to as "Design 1") to that shown in FIG. 12 (hereinafter referred to as "Design 2").

Oil pan testing was conducted under carefully controlled conditions on an engine dynamometer. The engine, oil system, and facilities (e.g. process water, fuel supply, ambient room conditions) were all fully instrumented with all sensor data being collected both during engine warming as well as during all tests. For all tests the engine was carefully brought to identical running conditions following a prescribed warm-up procedure. Once these conditions were met a test cycle was conducted comprising steady-state running at each of the three engine speeds noted in the test summary. This test was repeated at least three times for all configurations to ensure repeatability of the data collected.

Other than that, specified below, all parameters (namely, engine and test rig, oil cooling system, fuel rate and timing, oil and coolant flows, oil filter, boost pressure, air/fuel ratio) were the same as between Design 1 and Design 2. Testing for each design was performed at 2400 RPM, 2800 RPM, and 3150 RPM. The oil in the sump, oil pressure, and oil temperature were measured for each RPM. The oil in the rotating group is considered to be the balance of the total volume of oil in the engine, less the measured volume of oil in the sump.

FIG. 14 indicates the results of the testing. According to the data, Design 2 results in substantially more oil in the sump (i.e., measured sump level approximately 12 to 24% more depending on the RPM) and less resident oil in the engine crankcase (measured oil in rotating group approximately 11-23% less depending on the RPM) versus Design 1.

The data also evidences that Design 2 has reduced oil temperature and, in connection with the 2800 and 3150 RPM testing, increased oil pressure.

Additionally, aeration was measured at 3150 RPM. Aeration decreased by about 32%. This data shows Design 2 is a clear improvement over Design 1. As described herein the consequences of maintaining more oil in the pan where it is supposed to be and less resident oil in the rotating group, and less aeration increases the durability of the engine and the longevity of the engine oil. Decreased aeration also substantially increases the effectiveness of the oil to lubricate and to remove heat from moving parts. The inventor notes that even a single-digit performance percent change can amount to the difference between winning and losing an automotive race, improving fuel economy, and preventing oil starvation while operating a vehicle on an incline. The example described above shows double-digit percent improvements using the multiple discrete port configuration of FIG. 6A.

Many modifications and variations of the present invention are possible in light of the above teachings. For example, in embodiments, the oil accumulation ramp includes solely one or at least one air return port extending through the ramp from the oil sump to the crankcase.

Additionally, for embodiments, a flow delineator may be arranged on the side of an air return port regardless of whether the flow delineator is between two adjacent air return ports.

Additionally, although the system has been described with general reference to a "V" engine, the system is applicable to inline engines, "V" engines of any angle, and horizontally opposed engines (commonly referred to as flat or boxer engines). The invention is not intended to be so limited except where recited in any claims.

It is therefore to be understood that within the scope of the appended claims the invention may be practiced otherwise than as specifically described. Features and components may be made from multiple pieces or formed as single piece units. For example, although the oil pan assembly shown in FIGS. 5-6A is a one piece design, it could be made as two separate articles including an upper midpan and a lower sump affixed to the midpan (for example, as shown in FIG. 6B).

The invention claimed is:

1. A system for collecting lube oil in an oil sump in an internal combustion engine with a cranktrain, a plurality of crank bays and at least one main bearing bulkhead, the system comprising:

a first side wall and a second side wall opposite the first side wall;

an oil accumulation ramp comprising a top, and extending downwards from the second side wall to the first side wall, and separating the oil sump from the crankcase;

an oil entrance aperture arranged in the ramp adjacent the first side wall for directing oil accumulating on the ramp into the oil sump;

a plurality of air return ports extending through the ramp from the oil sump to the crankcase and spaced from the first side wall; and wherein each of the air return ports comprises an airflow director provided at the second side wall, for guiding air across the top of the oil accumulation ramp from the oil sump, and causing oil droplets to fall into the oil sump;

at least one flow delineator incorporated into the ramp and arranged adjacent to at least one air return ports to obstruct airflow and divert airflow into the adjacent air return ports; and wherein the air return ports and flow delineators are longitudinally located along the oil accumulation ramp such that each crank bay has one corresponding air return port and each main bearing bulkhead has one corresponding flow delineator; and wherein the plurality of air return ports and the flow delineators are positioned to aim air from the oil sump, across the oil accumulation ramp, and towards the oil entrance aperture thereby driving oil from the ramp into the oil sump.

2. The system of claim 1, wherein the at least one flow delineator has a recessed or depressed shape.

3. The system of claim 2 wherein the plurality of air return ports are arranged in a line from a front of the engine to a rear of the engine.

4. The system of claim 3, wherein at least one of the air return ports is arranged to direct fluid at an angle ($\sigma$) of 5 to 45 degrees from a median plane.

5. The system of claim 4, wherein at least one of the air return ports is arranged to direct fluid towards an oil pump pickup.

6. The system of claim 5, wherein the oil pump pickup is located midway between the front and the rear of the engine.

7. The system of claim 2, wherein a shape and flow direction of the plurality of air return ports are not identical.

8. The system of claim 2, wherein the port has a cross sectional shape with an aspect ratio (height to width) of 1/10 to 1/3.

9. The system of claim 2, wherein each of the plurality of air return ports has a cross section that varies with length.

10. The system of claim 9, wherein the cross section decreases with length.

11. The system of claim 10, wherein the cross section decreases in area with length by 10 to 50%.

12. The system of claim 1, wherein the first side wall, the second side wall, and the ramp are one integrally-formed midpan, and wherein the midpan is separatable but fastenable to the oil sump.

13. The system of claim 2, wherein a cover is movably arranged with each port to at least partially occlude flow through the port, and to permit unobstructed flow through the port, thereby adjusting air pressure and velocity in the oil sump.

14. The system of claim 13, further comprising a controller programmed and operable to move the cover of each port based on sensor data or feedback arising from the engine.

15. The system of claim 14, wherein the controller is programmed and operable to move the cover of each port based on engine speed.

16. The system of claim 1, wherein the ramp comprises a reverse turn or convex region and a flap extending from the convex region downward and towards the second wall to facilitate the release of oil droplets from an air oil mist into the sump.

17. The system of claim 16, further comprising a slat between the convex region and the first wall, wherein the slat is shaped and arranged with the ramp and the first wall to encourage flow attachment to the ramp and the convex region.

18. The system of claim 17, further comprising a divisor protruding from the first side wall, wherein the divisor comprises a concave upper face and a concave lower face to facilitate delivering oil through the oil entrance aperture and into the sump.

19. The system of claim 1, further comprising a throttling device movably arranged with each port to at least partially occlude flow through the port, and to permit unobstructed flow through the port, thereby adjusting air pressure and velocity in the oil sump.

20. An internal combustion engine having reduced lube oil aeration, the engine comprising:

an engine block comprising a plurality of cylinder bores, a rotating cranktrain and a plurality of oil passages, wherein the rotating cranktrain causes oil to circulate about the cranktrain along a first flowpath;

a crankcase arranged below the cylinder heads;

an oil sump for collecting and storing oil arranged below the crankcase;

an oil accumulation ramp comprising a top, and extending from a second side wall to a first side wall and separating the crankcase from the oil sump; and an entrance aperture in the ramp in the vicinity of the first wall to direct oil accumulated on the ramp into the oil sump;

a plurality of air return ports extending through the ramp from the oil sump to the crankcase, and wherein the plurality of air return ports are shaped and arranged to aim airflow from the sump across the ramp in the same direction as the first flowpath, thereby driving oil on the ramp towards the entrance aperture and into the oil sump; and at least one flow delineator or barrier incorporated into the ramp and arranged adjacent to at least one air return port to obstruct airflow and divert airflow into the adjacent air return ports; and wherein each of the air return ports comprises an airflow director provided at the second side wall, for guiding air across the top of the oil accumulation ramp from the oil sump, and causing oil droplets to fall into the oil sump.

21. The engine of claim 20, wherein at least one of the air return ports is arranged to direct fluid at an angle (σ) of 5 to 45 degrees from a median plane.

22. The engine of claim 21, further comprising an oil pump for driving the oil from the oil sump through the plurality of oil passages in the engine.

23. The engine of claim 22, further comprising an oil filter arranged along a flowpath of the oil, downstream of the oil pump, and prior to the plurality of oil passages.

24. The engine of claim 23, further comprising an oil cooler arranged along the flowpath of the oil, downstream of the oil pump, and prior to the oil passages.

25. A midpan for collecting lube oil in an oil sump in an internal combustion engine with a rotating cranktrain, the system comprising:

a first side wall comprising an upper interface to engage a first side of the crankcase, and a lower interface to engage a first side wall of the oil sump;

a second side wall opposite the first side wall comprising an upper interface to engage a second side of the crankcase, and a lower interface to engage a second side wall of the oil sump;

an oil accumulation ramp comprising a top, and extending downwards from the second side wall of the midpan to the first side wall of the midpan, and separating the oil sump from the crankcase; and an oil entrance aperture arranged in the ramp near the first side wall for directing oil accumulating on the ramp into the oil sump;

a plurality of air return ports extending through the ramp from the oil sump to the crankcase; and wherein each of the air return ports comprises an airflow director provided at the second side wall, for guiding air across the top of the oil accumulation ramp from the oil sump, and causing oil droplets to fall into the oil sump; and at least one flow delineator or barrier incorporated into the ramp and arranged adjacent to at least one air return port to obstruct airflow and divert airflow into the adjacent air return ports; and wherein the plurality of air return ports and at least one flow delineator are arranged (a) to deflect oil from the rotating cranktrain onto the ramp and towards the oil entrance aperture, and (b) to aim air from the oil sump along the ramp, thereby driving oil on the ramp towards the oil entrance aperture and into the oil sump.

26. The midpan of claim 25, wherein at least one of said plurality of air return ports forms an angle (omega) with a median plane through the midpan, and wherein the angle (omega) ranges from 5 to 45 degrees.

27. The midpan of claim 25, further comprising a throttling device movably arranged with each port of said plurality of air return ports to at least partially occlude flow through the port, and to permit unobstructed flow through the port, thereby adjusting air pressure and velocity in the oil sump.

* * * * *